US008550458B2

(12) United States Patent
Ohtsuki

(10) Patent No.: US 8,550,458 B2
(45) Date of Patent: Oct. 8, 2013

(54) PAPER FEEDER AND IMAGE FORMING APPARATUS

(75) Inventor: Ryohei Ohtsuki, Kyoto (JP)

(73) Assignee: Murata Machinery, Ltd., Kyoto-shi (JP)

( * ) Notice: Subject to any disclaimer, the term of this patent is extended or adjusted under 35 U.S.C. 154(b) by 0 days.

(21) Appl. No.: 13/563,624

(22) Filed: Jul. 31, 2012

(65) Prior Publication Data

US 2013/0049291 A1 Feb. 28, 2013

(30) Foreign Application Priority Data

Aug. 31, 2011 (JP) ..... 2011-189146

(51) Int. Cl.
*B65H 9/12* (2006.01)
*B65H 9/04* (2006.01)
*B65H 3/52* (2006.01)

(52) U.S. Cl.
USPC ..... 271/245; 271/241; 271/121

(58) Field of Classification Search
USPC ..... 271/241, 245, 121, 167
See application file for complete search history.

(56) References Cited

U.S. PATENT DOCUMENTS

| | | | | |
|---|---|---|---|---|
| 4,957,285 | A * | 9/1990 | Yamada | 271/3.02 |
| 5,346,197 | A | 9/1994 | Takano et al. | |
| 6,431,541 | B2 * | 8/2002 | Kuo et al. | 271/118 |
| 7,621,522 | B2 * | 11/2009 | Yasukawa et al. | 271/121 |
| 8,469,355 | B2 * | 6/2013 | Miwa | 271/124 |
| 2006/0097441 | A1 * | 5/2006 | Shikan et al. | 271/118 |
| 2008/0203652 | A1 * | 8/2008 | Yasukawa et al. | 271/117 |

FOREIGN PATENT DOCUMENTS

| | | |
|---|---|---|
| JP | 05-8907 | 1/1993 |
| JP | 07-125885 | 5/1995 |
| JP | 10-101250 | 4/1998 |
| JP | 2007-001684 | 1/2007 |

* cited by examiner

*Primary Examiner* — Patrick Cicchino
(74) *Attorney, Agent, or Firm* — Adli Law Group P.C.

(57) ABSTRACT

A paper feeder according to the present invention includes a paper entrance block arranged above a flapper on au upstream side of a paper feed roller in a paper feeding direction. The flapper is configured to be capable of swinging in a vertical direction so as to alter its position between a first position in which part of a top face thereof on a downstream side in the paper feeding direction comes into contact with the paper feed roller and a second position in which the part thereof is located lower than the first position. The paper entrance block is configured so that when the flapper is in the first position, the lower end thereof comes into contact with the flapper and when the flapper is in the second position, a clearance is formed in a vertical direction between the paper entrance block and the flapper.

10 Claims, 7 Drawing Sheets

PAPER FEEDER AND IMAGE FORMING APPARATUS

CROSS-REFERENCE TO RELATED APPLICATIONS

This application claims priority under 35 U.S.C. 119 to Japanese Patent Application No. 2011-189146, filed on Aug. 31, 2011, which application is hereby incorporated by reference in its entirety.

FIELD OF THE INVENTION

The present invention relates to a paper feeder for feeding sheets of paper loaded on a paper feed tray attached to an image forming apparatus to a paper conveying mechanism. The present invention also relates to an image forming apparatus including such a paper feeder.

BACKGROUND OF THE INVENTION

Typically, a manual bypass tray is attached to one side of an image forming apparatus, such as a copier, printer, facsimile or multifunctional peripheral combining the above functions. On the manual bypass tray, the following are arranged: a flapper that can swing in a vertical direction, a spring that continually urges the flapper upward with an elastic force and consequently allows the flapper to come into contact with a paper feed roller which is provided on a main unit end side of the flapper, a lever used to push the flapper downward and to release the pushed-down condition, and a separation pad made of an elastic member such as rubber that is elastically contacted with the paper feed roller.

The above paper feeder is configured so that when the paper feed roller is rotated while the sheets of paper loaded on the flapper are pressed against thereon, the sheets of paper can be fed to a paper conveying mechanism in response to rotation of the paper feed roller.

Some models of image forming apparatus require a user to push the flapper downward when the user loads sheets of paper on a manual bypass tray. In particular, some of low grade models manufactured at a low cost require the above operation. Once a user pushes the flapper downward, a vertical clearance is formed between a case of an apparatus and the flapper. Thus, when a user loads sheets of paper on the flapper under this circumstance, the user can put the edge of the sheets of paper to the depth of the flapper in a paper feeding direction. Then, when the pushed-down condition is released so as to push the flapper upward with an urging force of the spring, the sheets of paper can be properly positioned at a position where the sheets of paper are nipped between the paper feed roller and the separation pad. The sheets of paper properly nipped between the paper feed roller and the separation pad are fed to a paper conveying mechanism one by one in response to the rotation of the paper feed roller.

Generally, with the above described low grade models, while the manual bypass tray is opened, a vertical narrow clearance is already formed between the case and the flapper even before the flapper is pushed downward. Therefore, some users sometimes load sheets of paper on the flapper without pushing it downward and try to put (insert) the sheets of paper forcibly into the clearance formed above the flapper in an improper way.

While the flapper is not pushed downward, the vertical clearance between the flapper and the case is not wide enough. Therefore, when the sheets of paper are loaded on the flapper before the flapper is pushed downward, insertion of the sheets of paper into the clearance stops before the edge of the sheets of paper reaches the nipping position, that is, the insertion stops at an upstream side in the paper feeding direction and consequently the sheets of paper are not positioned at a proper position where the sheets of paper are nipped between the paper feed roller and the separation pad.

Most models of the image forming apparatus includes a sensor at this side of the paper feed roller (on an upstream side in the paper feeding direction) to sense whether a sheet (s) of paper is (are) loaded or not. When a command for printing operation is given after the sensor senses that the sheet(s) of paper is (are) loaded, a control unit provided in the image forming apparatus allows the paper feed roller to start rotating.

Even if sheets of paper are loaded on the flapper before the flapper is pushed downward, as the sheets of paper have reached a position close to a paper feed roller, some sensors might sense a presence of the sheets of paper loaded. Therefore, once a command for printing operation is given, the paper feed roller starts rotating. However, as the sheets of paper is not nipped properly between the paper feed roller and the separation pad, the paper feed roller cannot hold the sheets of paper properly and consequently cannot feed the sheets of paper to the paper conveying mechanism. Accordingly, the control unit recognizes that an error in paper setting has occurred and has a control panel indicate a notification on the loading error.

In this case, a user is at a loss as to why the error notification on paper setting is displayed although the sheets of paper has been loaded, and accordingly the user may spend a lot of time to identify the cause for the error. Further, in a case where a plurality of users share the same image forming apparatus in an office and the like, a similar error notification might be frequently displayed.

Some relatively expensive models of the image forming apparatus are configured so that the flapper is automatically pushed downward in accordance with opening of a manual bypass tray. In such a configuration, the above problem is unlikely to occur. However, in order to add such a function, a lot of components or controlling mechanisms need to be installed to such a lower grade model. Therefore, it will be difficult to provide the model with the function at a similar price range with the low grade model. Furthermore, for users who have already purchased such a low grade model, it is not easy to newly replace the image forming apparatus in order only to decrease the frequency of the occurrence of the above described error.

There is a need in the art for a paper feeder for an image forming apparatus in which a function to prevent errors in paper loading (errors in printing operation) has been included by adding a simple structure.

SUMMARY OF THE INVENTION

In order to solve the above described problems, the paper feeder according to the present invention includes a flapper on which sheets of paper are loaded, a paper feed roller for feeding the sheets of paper loaded on the flapper to the downstream side in the paper feeding direction, a paper entrance block which is provided above the flapper and is arranged on an upstream side of the feeding roller in the feeding direction.

The flapper is configured to be capable of swinging in a vertical direction so as to alter a position of the flapper between a first position in which part of a top face thereof on the downstream side in the paper feeding direction is located at a height position where the part of the top face thereof comes into contact with the paper feed roller and a second position in which the part of the top face thereof is located lower than the first position.

The paper entrance block is configured in the following way: when the flapper is in the first position, a lower end of the paper entrance block comes into contact with the top face of the flapper, and when the flapper is in the second position, a vertical clearance is formed between the lower end of the paper entrance block and the top face of the flapper.

With the paper entrance block configured as described above, before the flapper is pushed downward, that is, the flapper is in the first position, the lower end of the paper entrance block is in contact with the top face of the flapper. When a user loads sheets of paper on the flapper in such a condition, the paper entrance block serves as a barrier to block entry of the sheet of paper into the downstream side of the paper entrance block in the paper feeding direction. Therefore, the user becomes aware that he/she cannot put the sheets of paper into the depths of the flapper any longer and can also recognize in advance that there has been an error in setting the sheet of paper.

Then, when the flapper is pushed downward and goes into the second position, a clearance is formed between the top face of the flapper and the lower end of the paper entrance block. When the sheets of paper are loaded on the flapper in such a condition, a user can put the edge of the sheets of paper properly into the depth of the flapper. Then, when the flapper turns to the first position after release of the pushed-down condition, the edge of the sheets of paper comes into contact with the paper feed roller, and consequently the sheets of paper can be properly held.

The paper entrance block may be made of various materials, such as resin, film, rubber and the like.

It is preferred that the paper feeder according to the present invention is configure in the following way. That is, the paper feeder according to the present invention includes a sensor for sensing whether a sheet(s) of paper is (are) loaded on the flapper. Where the edge of the sheets of paper loaded on the flapper is located on an upstream side of the paper entrance block in the paper feeding direction, a loading of the sheets of paper is not sensed by the sensor. Meanwhile, where the edge of the sheets of paper loaded on the flapper is located at a predetermined position on a downstream side of the paper entrance block in the paper feeding direction, the loading of the sheets of paper is sensed by the sensor.

With the above configuration, where a user loads sheets of paper on the flapper without pushing the flapper downward, the loading of the sheets of paper is not sensed by the sensor. With the configuration that rotation of the paper feed roller is controlled only when the loading of the sheets of paper is sensed by the sensor, the paper feed roller is not allowed to rotate even if a command for printing operation is given while the sheets of paper are improperly loaded on the flapper as described above. Thus, the user can easily become aware of an error in paper loading. Where sheets of paper are loaded on the flapper while the flapper is being pushed downward (that is, in the second position), it becomes possible to put the edge of the sheets of paper to the downstream side of the paper entrance block, and accordingly the loading of the sheets of paper is sensed by the sensor. Thus, when a command for printing operation is given after that, the control unit has the paper feed roller start rotating.

It is also preferred that the paper feeder according to the present invention is configured in the following way. That is, in the paper feeder according to the present invention, the paper entrance block is configured to be capable of moving in the vertical direction. Further, once the top face of the flapper comes into contact with the lower end of the paper entrance block while the position of the flapper is shifting from the second position to the first position, the lower end position of the paper entrance block moves upward in accordance with an upward movement of the flapper while the lower end thereof is in contact with the top face of the flapper.

Such configuration allows the paper entrance block to maintain the function thereof even if a dimension error occurs in a manufacturing process. Hereafter, assume that the paper entrance block has been made long in length and is configured to be incapable of moving in the vertical direction. In this case, when the pushed-down condition of the flapper is released, the position thereof shifts from the second position to the first position, and then when the top face of the flapper comes into contact with the lower end of the paper entrance block, the upward movement of the flapper is stopped. Therefore, the flapper can stop rising without coming into contact with the paper feed roller, and consequently the paper feed roller cannot properly hold the sheet of paper loaded on the flapper.

Meanwhile, assume that the paper entrance block has been made long in length and is configured to be capable of moving in the vertical direction. With this configuration, when the top face of the flapper comes into contact with the lower end of the paper entrance block due to the release of the pushed-downward condition to alter the position of the flapper from the second position to the first position, the paper entrance block can keep rising upward in response to the following rising of the flapper. In other words, the paper entrance block does not interrupt the rising of the flapper. This configuration allows the flapper to rise until it comes into contact with the paper feed roller. Thus, even if a dimension error has occurred in a manufacturing process, the paper feed roller can properly catch the sheet (s) of paper loaded on the flapper.

It is also preferred that the paper feeder according to the present invention is configured in the following way. That is, the paper feeder according to the present invention is configured such that the lower end position of the paper entrance block is located lowermost due to the self weight thereof when the flapper is in the second position.

It is also preferred that the paper feeder according to the present invention is configured in the following way. That is, the paper feeder according to the present invention includes a mounting member arranged by coupling with the case. Further, the paper entrance block includes a hook. In the mounting member, an elongated hole is formed in the direction away from the top face of the flapper. The hook fits into the elongated hole and consequently the paper entrance block is mounted onto the mounting member with snap-fit effect.

It is also preferred that the paper feeder according to the present invention is configured in the following way. That is, with the paper feeder according to the present invention, when the top face of the flapper comes into contact with the lower end of the paper entrance block while the position of the flapper is shifting from the second position to the first position, the hook also moves upward in the elongated hole in response to the upward movement of the flapper.

It is also preferred that the paper feeder according to the present invention is configured in the following way. That is, the paper feeder according to the present invention includes an urging member for urging the flapper upward, and an operation lever that is manipulated to push the flapper downward. With the downward operating force by the operation lever and the upward urging force by the urging member, the flapper moves so as to alter a position of the flapper between the first position and the second position.

The paper feeder according to the present invention may be also configured in the following way. That is, the paper feeder may be configured as an image forming apparatus including one element of the paper feeder according to the present invention. Further, the paper feeder is a manually-feeding device including a manual bypass tray and the flapper is supported on the manual bypass tray.

The paper feeder according to the present invention may be also configured in the following way. That is, the present invention is configured as an image forming apparatus including a paper feeding device according to the present invention as one element of the present invention, wherein the paper feeding device is a manually-feeding device including a manual bypass tray, and the flapper is supported on the manual bypass tray. Further, where a command for printing operation is given from a user while a sheet of paper is not sensed by the sensor, an error notification indicating that the sheet of paper is not sensed will be displayed.

According to the present invention, only by installing a paper entrance block, it becomes possible to bring about the effect of preventing users from loading sheets of paper on a flapper without pushing the flapper downward. With this advantage, only addition of fewer components to a conventional image forming apparatus can lower the frequency of occurrence of errors in a process of printing operation.

The above and other elements, features, steps, characteristics and advantages of the present invention will become more apparent from the following detailed description of the preferred embodiments of the present invention with reference to the attached drawings.

DETAILED DESCRIPTION OF THE INVENTION

Figure 1:
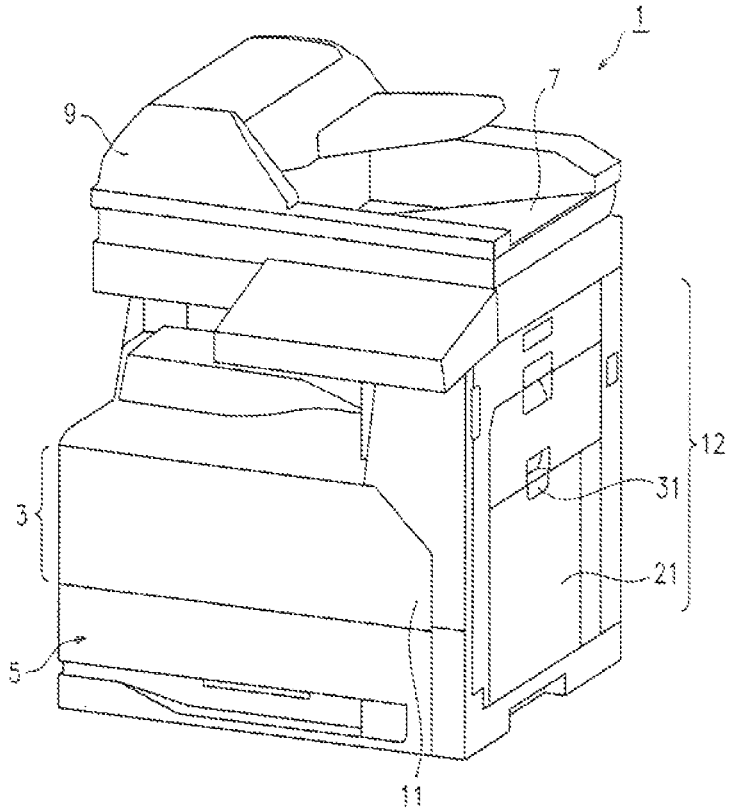
FIG. 1 is a schematic perspective view of an image forming apparatus including a paper feeder according to the present invention.

FIG. 1 is a schematic perspective view of an image forming apparatus 1 including a paper feeder according to the present invention, which is an embodiment of the present invention. An image forming apparatus may be any one of a copier, a printer, a facsimile or a multifunctional peripheral combining the above functions.

The image forming apparatus 1 includes a paper drawer 5 for stacking sheets of paper under a main unit 3 including an internal paper conveying mechanism for conveying the sheets of paper or an internal image forming mechanism for forming an image to a sheet of paper (both mechanisms are not illustrated), and above the main unit 3 an automatic document feeder (ADF) 9 for feeding the sheet(s) of paper placed on a document feeder 7. The main unit 3 has a front cover 11, and a manual bypass tray 21 for manually loading the sheets of paper on one side 12 of the apparatus.

Figure 2:
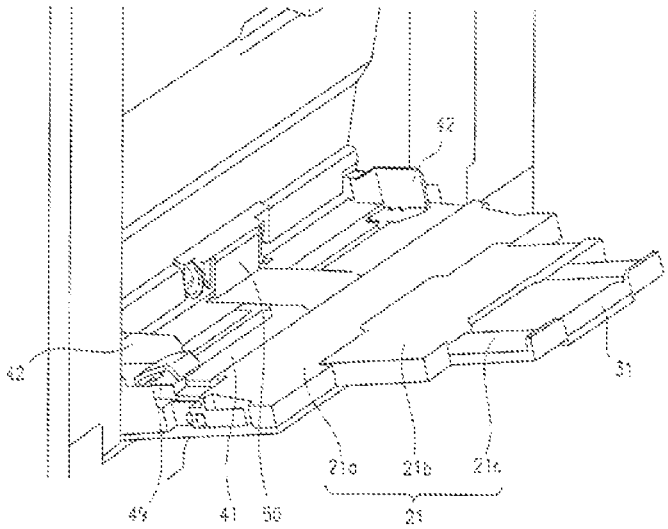
FIG. 2 is a schematic perspective view of a manual bypass tray which is opened.
Figure 3:
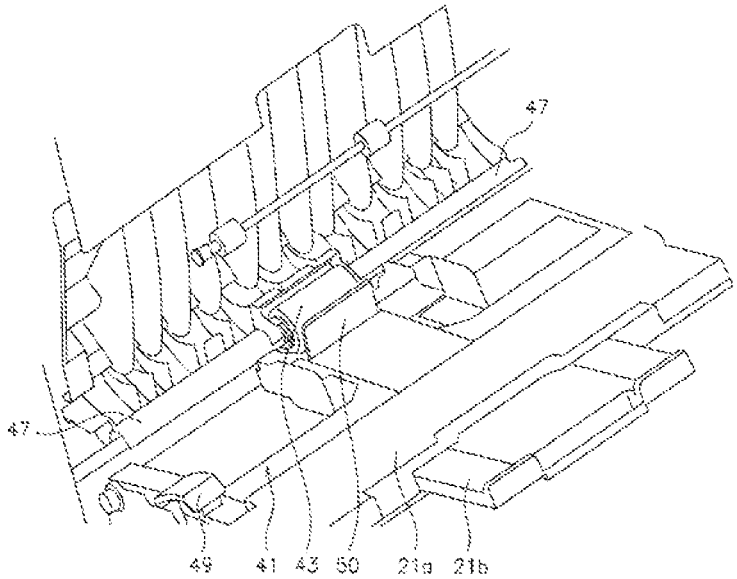
FIG. 3 is a more detailed schematic perspective view of the manual bypass tray which is opened.

FIG. 2 is a schematic perspective view of the manual bypass tray 21 which is opened. FIG. 3 specifically illustrates an internal structure of the main unit 3 of the manual bypass tray which is opened.

As illustrated in FIG. 2, the manual bypass tray 21 according to an embodiment of the present invention includes an extendable tray that can be stretched to different levels (21*a*, 21*b*, 21*c*). When using the manual bypass tray 21, a user opens the manual bypass tray 21 with a latch 31 and can adjust the extendable manual bypass tray 21 according to the size of a sheet of paper loaded thereon. In FIG. 3, the manual bypass tray 21 is extended to a level of 21*b*. The present invention is not limited to such a tray which can be stretched to the different levels or an extendable tray. Any type of trays can be adopted.

At a front end portion of the manual bypass tray 21 of the main unit 3 side (at the downstream side in the paper feeding direction), the following are provided: a flapper 41 for urging sheets of paper loaded thereon upward, a paper feed roller 43 arranged close to the front end portion of the flapper 41, a separation pad 45 (which is described later with reference to FIG. 5A), which is made of an elastic member such as rubber, arranged being in contact with the paper feed roller 43. Further, at each outer side of the paper feed roller 43, a paper feeding guide 47 is provided in the wide direction relative to the paper feeding direction. The paper feeding guide 47 is a member for guiding a sheet (s) of paper which is (are) nipped between the paper feed roller 43 and the separation pad 45 and is (are) fed in response to rotation of the paper feed roller 43 to the paper conveying mechanism inside the main unit 3. The manual bypass tray 21 also includes a paper width guide 42 for preventing a sheet(s) of paper loaded on the tray from deviating in the width direction relative to the paper feeding direction.

The flapper 41 is being urged upward with a spring 61 arranged thereunder (refer to FIG. 5A)).

Further, on a side of the top face of the flapper 41, an operation lever 49 is arranged at a position close to one end portion in the width direction thereof. The flapper 41 and the spring 61 formed thereunder are pushed downward when a user pulls the operation lever 49 upward. The operation lever 49 is configured so as not to be raised further when being pushed to a predetermined position. Meanwhile, when the operation lever 49 which has been pulled up is pushed down (depressed) (that is, releasing the pushing-upward condition), the force in pushing the flapper 41 downward is weakened, and consequently a position of the flapper 41 moves upward due to the urging force by the spring 61 arranged thereunder.

The operation lever 49 is not limited to the above described configuration. In other words, the operation lever 49 may be configured to be capable of altering the position of the flapper 41 between a position in which the flapper 41 and the spring 61 formed thereunder are pushed downward by manipulating the operation lever 49 and a position in which the flapper 41 is pushed upward until part of the top face of the flapper 41 comes into contact with the paper feed roller 43 when the pushed-down condition is released. The latter state is defined as a first position and the former state is defined as a second position.

Figure 4:
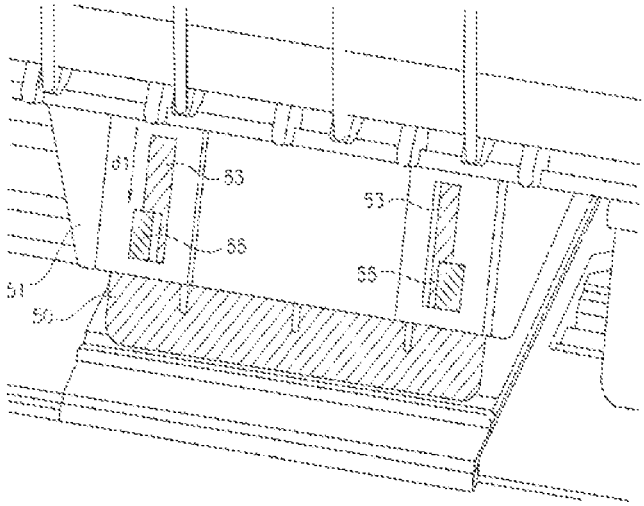
FIG. 4 is an enlarged drawing of a shutter provided in the manual bypass tray.

Further, at a position in this side of the paper feed roller 43 (in the direction opposite to the paper feeding direction), the manual bypass tray 21 includes a shutter 50 above the flapper 41 as a paper entrance block. FIG. 4 illustrates a specific structure of the shutter 50.

FIG. 4 is a view illustrating a schematic structure of the shutter 50 when viewed from the side of the main unit 3. By fitting a hook 55 of the shutter 50 into an elongated hole 53 of a shutter mounting member 51, the shutter 50 can be easily mounted onto the shutter mounting member 51 due to snap-fit effect. A portion of a front cover of the main unit 3 may be used as the shutter mounting member 51.

The hook 55 of the shutter 50 is capable of moving in the direction "d1" smoothly in the elongated holt 53. Where the top face of the flapper 41 is located lower than the lower end of the shutter 50, the movement of the hook 55 stops at a position where the hook 55 is located at the lower end of the elongated hole 53 due to self weight of the shutter 50. Where the top face of the flapper 41 is in contact with the lower end of the shutter 50, when the flapper 41 is pushed upward with the urging force of the spring 61 located thereunder, the hook 55 moves upward in the elongated hole 53 in response to the upward movement of the flapper 41. Accordingly, the lower end position of the shutter 50 also moves upward while being in contact with the top face of the flapper 41.

Figure 5A:
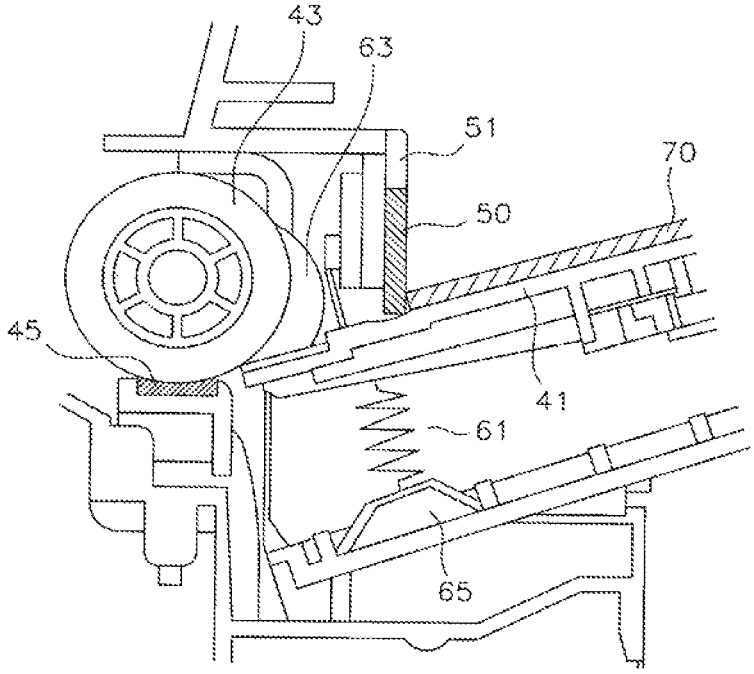
FIG. 5A is a schematic view of a peripheral portion of a paper feed roller viewed from the direction substantially perpendicularly to the feeding direction before the flapper is pushed downward.
Figure 5B:
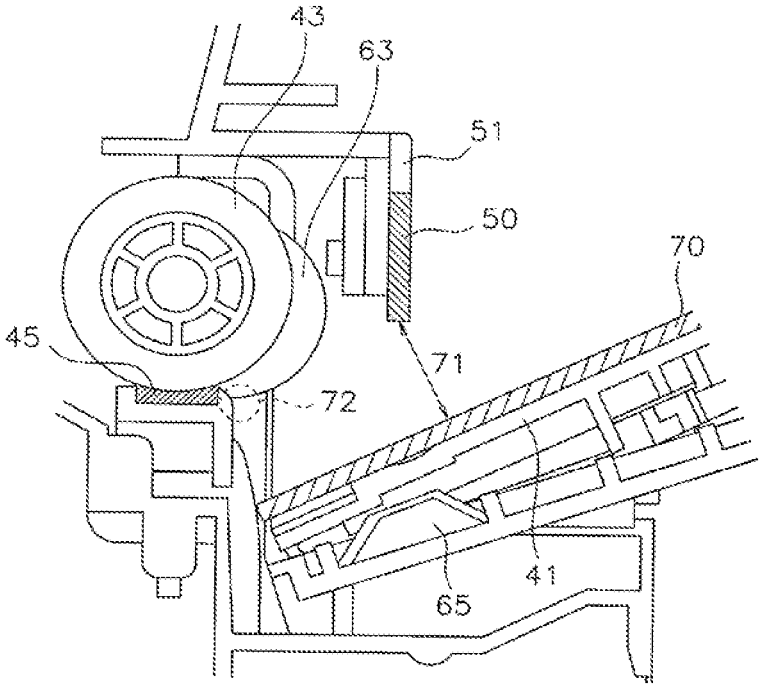
FIG. 5B is a schematic view of the peripheral portion of the paper feed roller viewed from the direction substantially perpendicularly to the feeding direction after the flapper is pushed downward.

FIGS. 5A and 5B are schematic views of a peripheral portion of the paper feed roller 43 (illustrated in FIG. 3) which is viewed from the direction substantially perpendicular to the paper feeding direction. FIG. 5A illustrates a state of the peripheral portion of the paper feed roller 43 before the flapper 41 is pushed downward, and FIG. 5B illustrates a state thereof after the flapper 41 is pushed downward.

As illustrated in FIG. 5A, in the state before the flapper 41 is pushed downward, the flapper 41 is being urged upward from the base 65 of the manual bypass tray 21 with the spring 61 and the lower end of the shutter 50 is in contact with the top face of the flapper 41, and a vertical clearance is not formed in this positioning. Therefore, when a user loads sheets of paper 70 on the top face of the flapper 41 and is trying to put the sheets of paper until the edge of the sheet of paper reaches the paper feed roller 43 (at the downstream side in the paper feeding direction), the shutter 50 serves as a barrier to prevent the further entry of the sheets of paper.

Thus, where a sensor for sensing a presence of the sheets of paper 70 is installed near the paper feed roller 43, when the entry of the sheets of paper stops in front of the shutter 50 (at the upstream side in the feeding direction) as illustrated in FIG. 5A, the presence of the sheets of paper 71 is not sensed by the sensor 50. Then, the sensor 63 transmits a signal indicating that the sheet of paper has not been sensed to a control unit (not illustrated) of the image forming apparatus 1. Thus, where a command for printing operation is given under this circumstance, the control unit displays an error notification indicating the sheets of paper has not been sensed on a control panel, and does not allow the paper feed roller 43 to start rotating. With this error notification, users are able to become aware that the sheets of paper have not been loaded properly.

Meanwhile, where the user manipulates the operation lever 49 to push the flapper 41 downward close to the base 65 as illustrated in FIG. 5B, a vertical clearance 71 is created between the lower end of the shutter 50 and the top face of the flapper 41. Therefore, when loading sheets of paper 70 on the top face of the flapper 41 under this circumstance, the user can put the sheets of paper 70 to the downstream side to reach the depth of the flapper 41. Accordingly, when the user manipulates the operation lever 49 to push the flapper 41 upward again after that, it becomes possible for users to position the sheets of paper at a nipping position 72 between the paper feed roller 43 and the separation pad 45. Thus, where a command for printing operation is given under this circumstance, the control unit allows the paper feed roller 43 to rotate, and accordingly the sheets of paper 70 nipped there between are fed to the paper conveying mechanism.

Figure 5C:
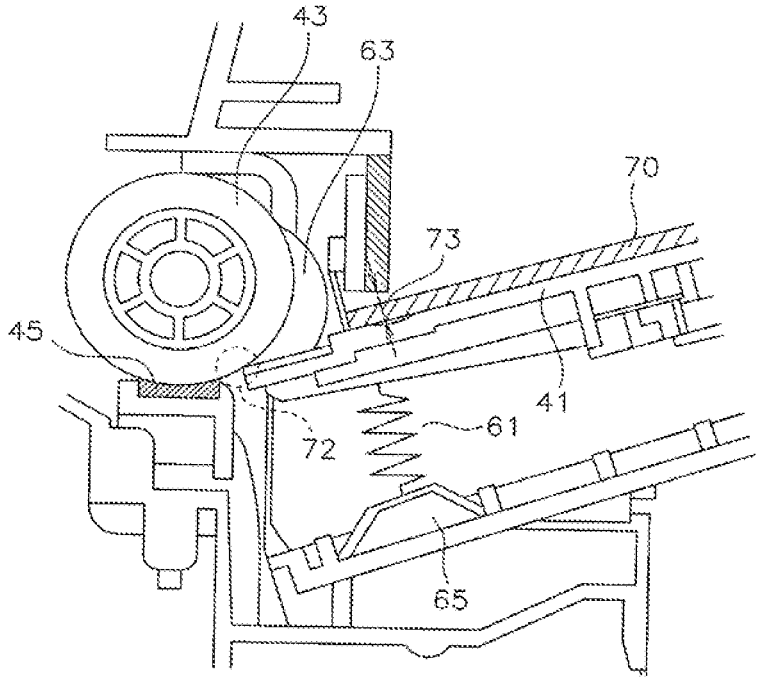
FIG. 5C is a schematic view of the peripheral portion of the paper feed roller of a conventional image forming apparatus viewed from the direction substantially perpendicularly to the feeding direction before the flapper is pushed downward.

As illustrated in FIG. 5C, with a conventional image forming apparatus without the shutter 50, a clearance 73 has been already formed above the top face of the flapper 41 even before the flapper 41 is pushed downward, and therefore it becomes possible to put the sheets of paper close to the paper feed roller 43. In this case, the presence of the sheets of paper 70 is sensed by the sensor 63. Therefore, when a command for printing operation is given, the control unit allows the paper feed roller 43 to rotate. However, the edge of the sheets of paper 70 has not reached the nipping position 72 and therefore the paper feed roller 43 cannot hold the sheets of paper 70 properly and is also incapable of feeding the sheets of paper to the paper conveying mechanism.

As described above, with the image forming apparatus 1 according to the present invention, when sheets of paper 70 are loaded on the flapper 41 before the flapper is pushed downward, the presence of the sheets of paper is not sensed by the sensor 63. Consequently, when a command for printing operation is given in such a condition, the paper feed roller 43 is not allowed to rotate and an error notification indicating that the sheets of paper has not been loaded properly will be displayed. Accordingly, users can easily identify the cause for the error as well as its solution.

The image forming apparatus 1 according to the present invention 1 can bring about an effect of preventing errors in printing operation in a case where sheets of paper 70 are loaded on the flapper 41 before the flapper 41 is pushed downward only by installing the shutter 50 as a member for blocking the entry (insertion) of the sheets of paper. In other words, the above effect can be achieved by only installing a fewer components into an image forming apparatus with a conventional structure. Thus, in terms of the above-described aspect, it can be said that the present invention is an extremely efficient technology for users since users do not need to newly purchase a more expensive model.

In the embodiments of the present invention, the hook 55 is configured to be capable of moving in the vertical direction in the elongated hole 53 and the height position of the lower end of the shutter 50 can be changed according to the movement of the hook 55. This configuration has been invented in consideration of dimensional errors in a manufacturing process. In other words, if the shutter 50 has been made that the lower end position thereof is located lower than the nipping portion 72, where the shutter 50 is incapable of moving in the vertical direction, when the pushed-down condition is released and the top face of the flapper 41 comes into contact with the lower end of the shutter 50, the flapper 41 will no longer be moved upward. That is, with this configuration, the top face of the flapper 41 does not come into contact with the paper feed roller 43, and consequently the paper feed roller 43 may not catch the sheets of paper 70 loaded on the top face of the flapper 41.

Otherwise, if the shutter 50 has been made that the lower end position thereof is located further above the nipping position 72, a clearance has been already formed between the flapper 41 and the lower end of the shatter 50 in a state in which the flapper 41 is not pushed downward. In this case, the shutter 50 can no longer function as a paper entrance block that prevents the sheets of paper 70 from entering into the paper feeding direction before the flapper 41 is pushed downward.

Meanwhile, by making the shutter 50 to be capable of moving in the vertical direction, the following are achieved even if the shutter 50 has been made that the lower end position thereof is located lower than the nipping position 72 as described above: after the top face of the flapper 41 comes into contact with the lower end of the shutter 50 when the pushed-down condition of the flapper 41 is released, it becomes possible to move the flapper 41 upward in response to the upward movement of the shutter 50 while the hook 55 is moving upward in the elongated hole 53. Thus, even in such a configuration, it becomes possible to properly nip the sheets of paper 70 loaded on the flapper 41.

In other words, if there is no possibility that any dimensional error occur in a manufacturing process, the dimension (height) of the shutter 50 can be fixed at a predetermined size.

Further, while the flapper 41 is in contact with the paper feed roller 43 (that is, a state in which sheets of paper are nipped), the lower end of the shutter 50 needs to be in contact with the top face of the flapper 41. This is because, if the lower end of the shutter 50 is located above the top face of the flapper 41 while the flapper 41 is in contact with the paper feed roller 43, a clearance has been formed above the flapper 41 before the flapper 41 is pushed downward, which might cause the same problem as the conventional image forming apparatus.

Further, it is preferred that a clearance whose height is equivalent to or greater than a thickness of an estimated number of sheets of paper 70 that can be loaded on the manual bypass tray 21 is formed in the vertical direction between the top face of the flapper 41 and the lower end of the shutter 50. However, this is not an essential requirement. In other words, if the lower end of the shutter 50 moves upward in accordance with an upward movement of the hook 55 in the elongated hole 53 due to the weight of the sheets of paper 70 loaded thereon, and accordingly the number of sheets of paper which can be loaded increases, it is not always required that a clearance whose height is equivalent to or greater than the thickness that is enough to contain the estimated number of sheets of paper 70 that can be loaded thereon has been formed before the flapper 41 is pushed downward. However, in this case, the lower end position of the shutter 50 needs to be configured to be capable of moving in the vertical direction as described in the above embodiments.

As a material for the shutter 50, various materials including plastic, rubber, film or the like can be used.

The above embodiments of the present invention have been described based on the assumption that the shutter 50 is provided on the manual bypass tray. However, a similar shutter 50 may be installed on a paper feeding tray inside the paper drawer 5.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A paper feeder comprising:

a flapper for loading sheets of paper thereon, a paper feed roller arranged to feed the sheets of paper loaded on the flapper to a downstream side in a paper feeding direction, and a paper entrance block formed above the flapper on an upstream side of the paper feed roller in the paper feeding direction;

wherein the flapper is configured to be capable of swinging in a vertical direction to alter a position thereof between a first position in which part of a top face thereof on the downstream side in the paper feeding direction is located at a height position where the part of the top face thereof comes into contact with the paper feed roller and a second position in which the part of the top face thereof is located lower than the first position; and wherein the paper entrance block is configured such that when the flapper is in the first position, a lower end of the paper entrance block comes into contact with the top face of the flapper, and when the flapper is in the second position, a clearance is formed in the vertical direction between the lower end of the paper entrance block and the top face of the flapper.

2. The paper feeder according to claim 1 further comprising:

a sensor arranged to sense that at least one sheet is loaded on the flapper; wherein when an edge of the sheets of paper loaded on the flapper is located on the upstream side of the paper entrance block in the paper feeding direction, a loading of the sheets of paper is not sensed by the sensor, and when the edge of the sheets of paper loaded on the flapper is located at a predetermined position on the downstream side of the paper entrance block in the paper feeding direction, the loading of the sheet of paper is sensed by the sensor.

3. The paper feeder according to claim 1, wherein the paper entrance block is configured to be capable of moving in the vertical direction, and when the top face of the flapper comes into contact with the lower end of the paper entrance block while the position of the flapper is shifting from the second position to the first position, the lower end position of the paper entrance block also moves upward in response to an upward movement of the flapper while the lower end thereof is in contact with the top face of the flapper.

4. The paper feeder according to claim 3, wherein the lower end position of the paper entrance block is located lowermost while the flapper is in the second position.

5. The paper feeder according to claim 4 comprising:

a mounting member arranged by coupling with a case of the apparatus, wherein the paper entrance block includes a hook, and an elongated hole is formed in the mounting member in a direction leaving away from the top face of the flapper, wherein by fitting the hook into the elongated hole, the paper entrance block is mounted on the mounting member with a snap-fit effect.

6. The paper feeder according to claim 5, wherein when the top face of the flapper comes into contact with the lower end of the paper entrance block while the position of the flapper is shifting from the second position to the first position, the hook also moves upward in the elongated hole in response to the upward movement of the top face of the flapper.

7. The paper feeder according to claim 1 further comprising:

an urging member arranged to urge the flapper upward, and an operation lever that is manipulated to push the flapper downward, wherein the flapper swings so as to alter the position of the flapper between the first position and the second position based on a downward operating force by the operation lever and an upward urging force by the urging member.

8. An image forming apparatus including the paper feeder according to claim 1, wherein the paper feeder is a manually-feeding device including a manual bypass tray, and the flapper is supported on the manual bypass tray.

9. The image forming apparatus including the paper feeder according to claim 2, wherein the paper feeder is a manually-feeding device including a manual bypass tray, and the flapper is supported on the manual bypass tray, where a command for printing operation is given when a sheet of paper is not sensed by the sensor, an error notification indicating that the sheet of paper has not been sensed will be displayed.

10. A method of making an image comprising making the image with an image forming apparatus having the paper feeder of claim 1.

* * * * *